US008141318B2

(12) United States Patent
Dunbar et al.

(10) Patent No.: US 8,141,318 B2
(45) Date of Patent: Mar. 27, 2012

(54) METAL ROOF TRUSS HAVING GENERALLY S-SHAPED WEB MEMBERS

(75) Inventors: David C. Dunbar, Winter Haven, FL (US); William L. Babich, Orlando, FL (US); Greg Kelling, West Ampton, NJ (US)

(73) Assignee: Illinois Tool Works, Inc., Glenview, IL (US)

( * ) Notice: Subject to any disclaimer, the term of this patent is extended or adjusted under 35 U.S.C. 154(b) by 22 days.

(21) Appl. No.: 12/243,813

(22) Filed: Oct. 1, 2008

(65) Prior Publication Data

US 2010/0077692 A1 Apr. 1, 2010

(51) Int. Cl.
*E04B 7/08* (2006.01)
*E04B 3/02* (2006.01)

(52) U.S. Cl. ..... 52/636; 52/639; 52/692; 52/693; 52/90.1; 52/846; 52/856

(58) Field of Classification Search ..... 52/633, 52/636, 637, 638, 639, 643, 692, 693–695, 52/697, 838, 90.1, 856, 846
See application file for complete search history.

(56) References Cited

U.S. PATENT DOCUMENTS 3,827,117 A * 8/1974 Ollman ..... 29/897.31
4,982,545 A * 1/1991 Stromback ..... 52/639
4,986,051 A 1/1991 Meyer et al.
5,079,884 A * 1/1992 Menchetti ..... 52/241
5,215,331 A * 6/1993 Pittman ..... 280/788
5,417,028 A 5/1995 Meyer
5,457,927 A 10/1995 Pellock et al.
5,463,837 A 11/1995 Dry
5,746,039 A 5/1998 Nystrom
5,771,653 A * 6/1998 Dolati et al. ..... 52/846
5,787,651 A 8/1998 Horn
5,816,012 A 10/1998 Willis
6,073,414 A 6/2000 Garris et al.

(Continued)

FOREIGN PATENT DOCUMENTS

JP 04108940 A * 4/1992

(Continued)

OTHER PUBLICATIONS

Ultra-Span Chords and Webs; Aegis Metal Framing, LLC; Section Drawings; www.aegismetalframing.com; (Admited Prior Art) date unknown.

*Primary Examiner* — Jeanette E. Chapman
(74) *Attorney, Agent, or Firm* — Booth Albanesi Schroeder LLC; Peter V. Schroeder; John F. Booth

(57) ABSTRACT

The metal truss assembly disclosed herein is made from generally U-shaped metal chords and multiple generally S-shaped web members extending between the chords. A typical truss assembly has a pair of elongated, opposed, diverging metal upper chords and a lower chord, with the chords each forming generally U-shaped channels defining an interior chord space. A plurality of elongated metal web members extend between the upper and lower chords, with each of the web members extending into the interior space of an upper chord and the lower chord and attached to the chords. The web members, as taught herein, have a generally S-shaped cross-section. The shape of the web members is an advancement of prior art web members.

20 Claims, 6 Drawing Sheets

U.S. PATENT DOCUMENTS

| | | | | |
|---|---|---|---|---|
| 6,088,988 | A | 7/2000 | Sahramaa | |
| 6,131,362 | A | 10/2000 | Buecker | |
| 6,167,674 | B1 | 1/2001 | Nanayakkara | |
| 6,260,327 | B1 | 7/2001 | Pellock | |
| 6,658,809 | B2 | 12/2003 | Collins | |
| 6,817,155 | B2 * | 11/2004 | Larson | 52/690 |
| 6,874,294 | B2 | 4/2005 | Masterson et al. | |
| 6,964,140 | B2 | 11/2005 | Walker et al. | |
| 7,513,085 | B2 * | 4/2009 | Moody et al. | 52/639 |
| 7,669,379 | B2 * | 3/2010 | Schierding | 52/634 |
| 2008/0295442 | A1 * | 12/2008 | Moody et al. | 52/634 |

FOREIGN PATENT DOCUMENTS

JP 09268677 A * 10/1997

* cited by examiner

METAL ROOF TRUSS HAVING GENERALLY S-SHAPED WEB MEMBERS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

TECHNICAL FIELD

The invention relates to a metal roof truss having an upper and lower chord and a plurality of web members extending between the chords, and more particularly, to such a truss wherein the web members are of a generally S-shaped cross-section.

BACKGROUND OF THE INVENTION

Metal roof trusses may take on various shapes, but the most commonly encountered shape is defined by two upper chords joined at adjacent ends and each connected to a lower chord to create a generally triangular truss. Extending between the upper and lower chords are a plurality of web members.

The prior art teaches various cross-sectional shapes for the upper and lower chords, including generally U-shaped or C-shaped chords. Prior art chord shapes are taught at U.S. Pat. No. 5,771,653 to Dolati, which is incorporated herein in its entirety for all purposes. The prior art also teaches J-shaped and Z-shaped chord members, as well as other shapes.

The prior art also teaches various cross-sectional shapes for the web members of metal trusses, namely, C-shaped web members or rectangular tubular members. For example, U.S. Pat. No. 6,874,294 to Masterson teaches a generally C-shaped (or U-shaped) cross-section for the truss web member. Similar web member cross-sections are taught at U.S. Pat. Nos. 6,260,327 to Pellock, 6,658,809 to Collins, 5,463,837 to Dry, and 6,167,674 to Nanayakkara. Also in common use are web members of rectangular and square tubular members. The use of square and rectangular tubulars as web members is taught in, for example, U.S. Pat. Nos. 5,771,653 to Dolati, 6,088,988 to Sahramaa, 5,417,028 to Meyer, and 4,986,051 to Meyer. More exotic web member shapes, such as an H-shape and W-shape, have also been employed in the prior art. See, for example, U.S. Pat. Nos. 5,457,927 to Pellock, and 6,073,414 to Garris, et al.

The C-shaped web members have significant drawbacks. A C-shaped member is prone to flexural torsional buckling for any given gauge or thickness of metal in comparison to a tubular or S-shaped web member. This is because the center of gravity and center of shear of a C-shaped member do not coincide. Consequently, a C-shaped member requires the use of relatively thicker metal or requires lateral bracing to provide additional strength. Additionally, a C-shaped member, in torsional buckling mode, precludes the use of continuous lateral bracing along only one edge of the web member. The use of heavier gage metal or significant lateral bracing increases the cost of manufacture and production of the metal truss.

The use of tubular pieces, either square or rectangular, as truss web members results in greater strength for any given gauge of metal, however, the tubular must either be cold-rolled and then welded along a seam, or otherwise hot-rolled. Hot-rolled members are more expensive to manufacture than cold-rolled members. Similarly, the additional step of welding cold-rolled tubulars adds cost over cold-rolled tubulars without welding. Additionally, welded tubulars must be sealed after welding to prevent rusting, especially along the welded seam.

Consequently, there is a need for a metal truss and method of manufacture of metal trusses, having web members which are less expensive than a tubular member and which provides adequate strength without the need to use a heavier gauge metal.

SUMMARY OF THE INVENTION

The metal truss assembly disclosed herein is made from generally U-shaped metal chords and multiple generally S-shaped web members extending between the chords. A typical truss assembly has a pair of elongated, opposed, diverging metal upper chords and a lower chord, with the chords each forming generally U-shaped channels defining an interior chord space. A plurality of elongated metal web members extend between the upper and lower chords, with each of the web members extending into the interior space of an upper chord and the lower chord and attached to the chords. The web members, as taught herein, have a generally S-shaped cross-section. The shape of the web members is an advancement of prior art web members.

The web member has a central web, an upper flange extending from the central web, an upper leg extending from the upper flange, an upper return extending from the upper flange, a lower flange extending from the central web, a lower leg extending from the lower flange, and a lower return extending from the lower leg. The upper and lower returns may have lip portions extending from them. The upper and lower flanges are generally parallel to one another, the upper and lower legs are generally parallel to one another, the upper and lower returns are generally parallel to one another, and the upper flange and lower return are generally coplanar, and the lower flange and upper return are generally coplanar.

The central web of the web member can be generally perpendicular to the upper and lower flanges or lie at a diagonal in relation to the upper and lower flanges. The central web may have a planar middle portion and two end portions positioned at diagonals with respect to the middle portion. The angled end portions of the central web guide the user in inserting fasteners through the web member.

The web members preferably have a center of gravity and a center of shear which coincide. This improves the strength and performance of the web members. Further, the center of gravity and center of shear preferably fall within the cross-sectional area of the web member.

BRIEF DESCRIPTION OF THE DRAWINGS

The accompanying drawings are incorporated into and form a part of the specification to provide illustrative examples of the present invention and to explain the principles of the invention. The drawings are only for purposes of illustrating preferred and alternate embodiments of how the invention can be made and used. The drawings are not to be construed as limiting the invention to only the illustrated and described examples. Various advantages and features of the present invention will be apparent from a consideration of the accompanying drawings in which.

DETAILED DESCRIPTION OF PREFERRED EMBODIMENTS

Figure 1:
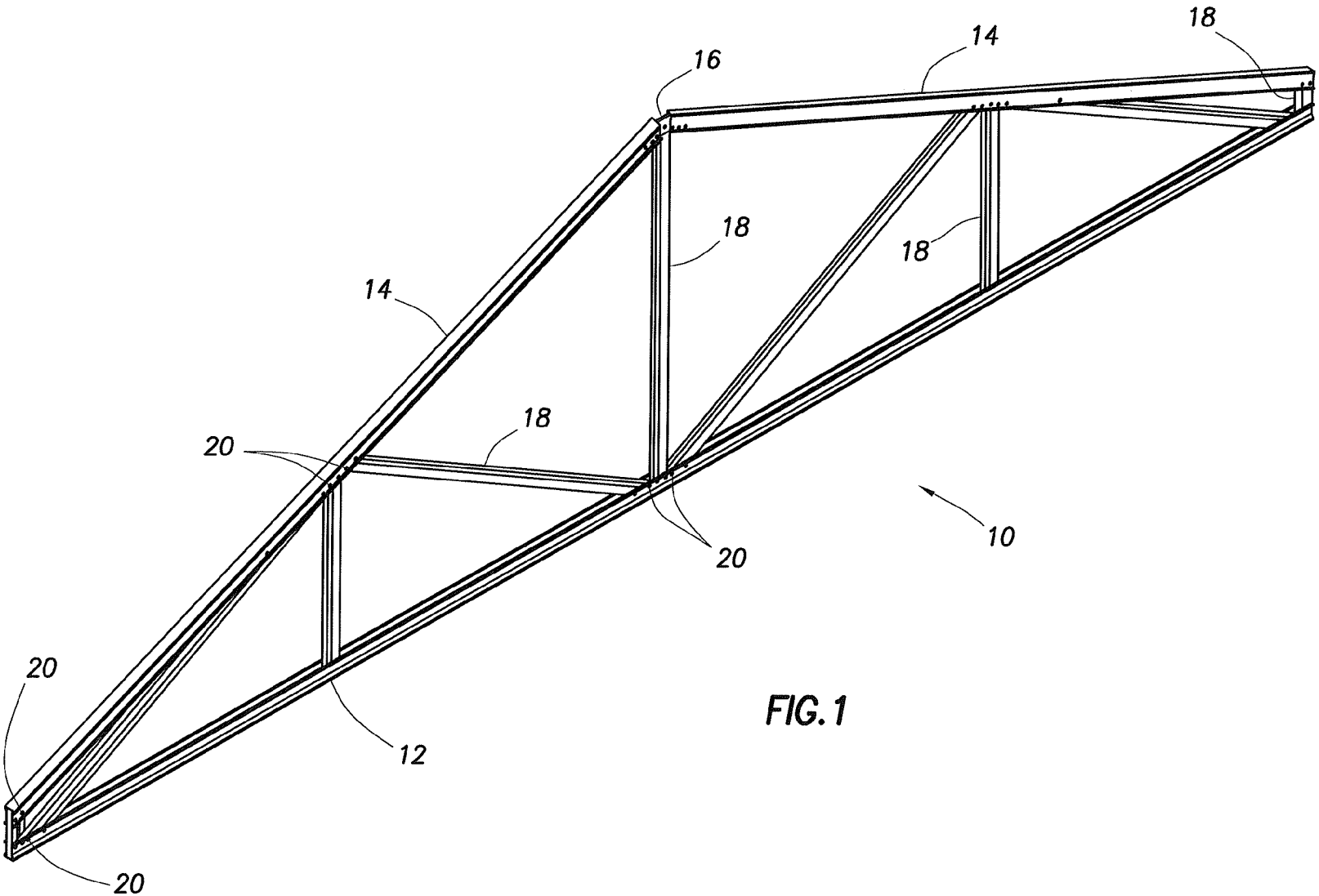
FIG. 1 is an orthogonal view of one embodiment of the invention, showing a metal truss having upper chords, a lower chord and multiple web members extending between the chords.

FIG. 1 is a perspective view of an exemplary metal truss 10. The truss 10 typically employs a bottom or lower chord 12 and two top or upper chords 14. The upper chords 14 are attached to one another at peak 16 by various means known in the art. The upper chords 14 and lower chord 12 are attached to one another, either directly using some means of attachment, or indirectly, through web members 18, as shown. A typical metal roof truss 10, as seen in FIG. 1, has two elongated, diverging upper chords 14 arranged opposed to one another. It is also possible to employ a single upper chord for flat roofs, floor trusses and the like, or three or more upper chords for more complicated or lengthy trusses. Typically, a single lower chord 12 is employed, however, it is also possible to employ two or more lower chords to provide extra length or allow for a truss having a vaulted design and the like.

Web members 18 and chords 12 and 14 are attached to one another. Multiple elongated metal web members 18 extend between the upper and lower chords 12 and 14. Any means of attachment may be used, including welding, adhesives or fasteners, such as screws, bolts, rivets, etc. Preferably, fasteners 20 are self-tapping screws. The fasteners 20 may be used to attach web members 18 to chords 12 and 14, as shown, or may be used to attach two chords to one another directly.

Figure 2:
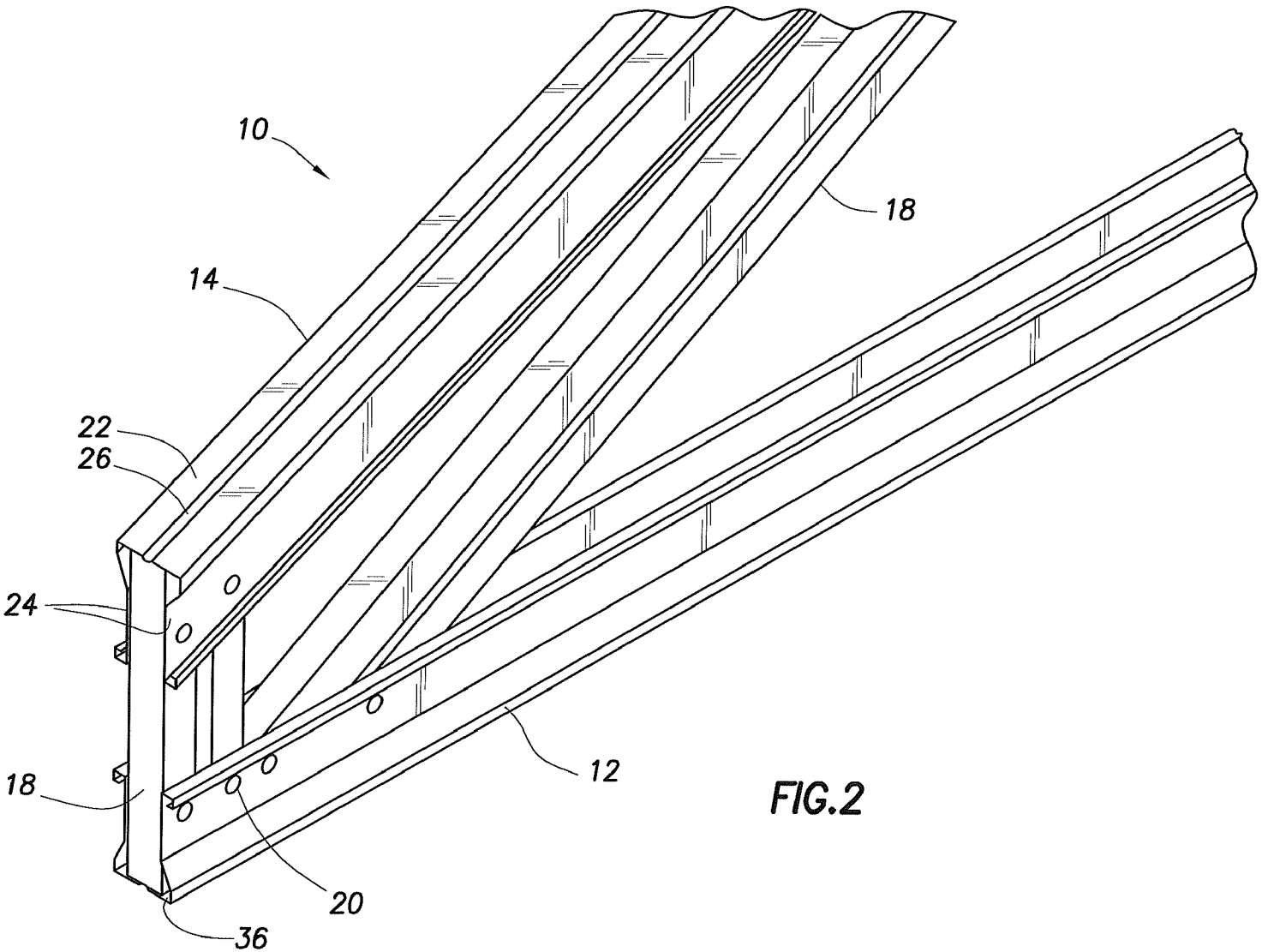
FIG. 2 is a detail, orthogonal view of one end of the embodiment of the metal truss seen in FIG. 1.

FIG. 2 is a detail, orthogonal view of one end of the embodiment of the metal truss seen in FIG. 1. Lower chord 12 is attached to web members 18 using fasteners 20. Upper chord 14 is attached to one of the web members 18 using fasteners 20.

The chords 12 and 14 are each generally U-shaped, having a base 22 and two opposed, generally parallel legs 24 extending from opposite ends of the base 22. Turning to a typical chord, the legs 24 of the chord 12 are shown as having the same length, or extending the same distance from the chord base 22. This is the preferred embodiment, but chord legs 24 need not be of the same length. The term "U-shaped" used to describe the chords includes U-shaped chords wherein one leg 22 is shorter than the other, or what might be called a J-shaped chord. The chords 12 and 14 each are in the shape of and form a channel with an interior space 36 defined by the base 22 and legs 24.

A preferred embodiment of the upper and lower chords is seen in FIG. 2. Each chord 12 and 14 is generally U-shaped, having a base 22 and a pair of legs 24. The base 22 is generally planar throughout the length of the chord and may have a central, depressed, arcuate stiffening rib 26 formed therein and extending the length of the chord. Preferably, the chord legs 24 are mirror images of each other.

Figure 3:
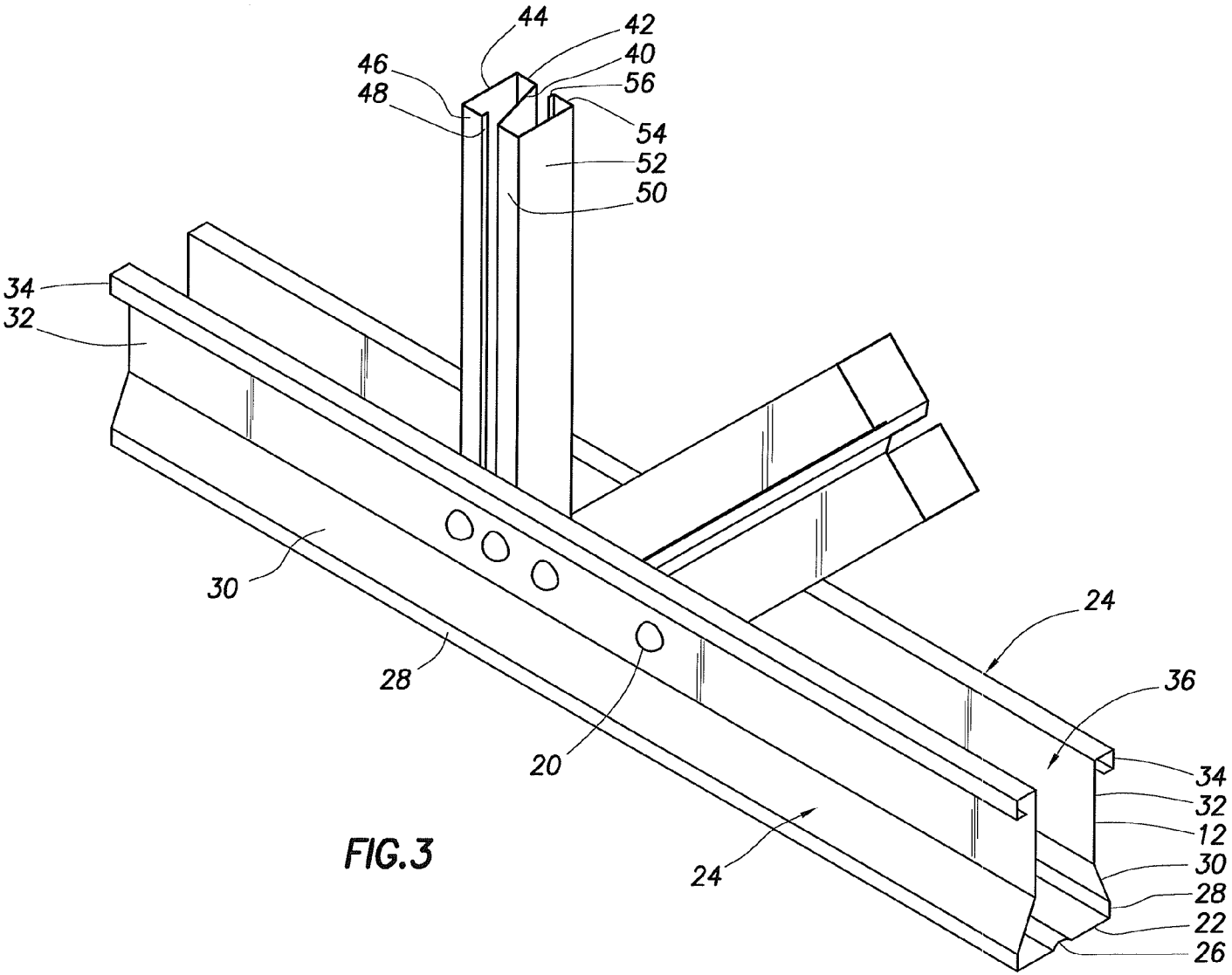
FIG. 3 is a partial, orthogonal view of a section of a lower chord and two web members of the embodiment of the invention.

FIG. 3 shows a preferred embodiment of a chord in greater detail. Each leg 24 has a first planar portion 28. The portion 28 is generally perpendicular to base 22. The portion 28 is followed by a planar, inwardly sloping portion 30. The sloping portion 30 terminates in a planar portion 32 which serves as an attachment portion and which is generally perpendicular to the base 22 and generally parallel to first planar portion 28. At its lowermost end, the attachment portion 32 is provided with a flange 34. The chord flange 34 extends outwardly from the attachment portion 32. The chord flange 34 may be curled or squared, as shown. The opposing legs 24 are preferably mirror images of each other, as shown. The preferred embodiment of the chords is explained in detail in U.S. Pat. No. 5,771,653 to Dolati, which is incorporated herein for all purposes. The chord as taught by Dolati is an exemplary chord and the invention herein is not limited to the specifics of the Dolati teachings except as required by the claims of this patent. For example, the chord of the present invention does not need to have legs which are mirror images of one another, legs of equal length, a stiffening rib in the base, or sloping wall portions.

FIG. 3 also shows two preferred embodiments of web members 18. The web members 18 are preferably formed of a uniform thickness metal, such as light gauge steel. Other metals, such as aluminum, may be used as well. The gauge or thickness of the metal is selected depending on the strength requirements for the truss assembly. The web members can be coated with a sealant or other coating to retard or prevent rust and decay. Further, the web members disclosed herein are designed to be manufactured by cold-rolling. They can be formed by other manufacturing means as is known in the art. The web members are not "closed" such as with a rectangular or circular tubular. The web members are designed such that they do not require either manufacture by hot-rolling or a weld along a seam after being cold-rolled. Cold-rolled web members are cheaper to manufacture and result in a more cost efficient truss assembly. Similarly, eliminating the need for a weld reduces cost associated with the welding and the need to then seal or coat the web member after the welding to protect against rust and decay along the seam.

Figure 4:
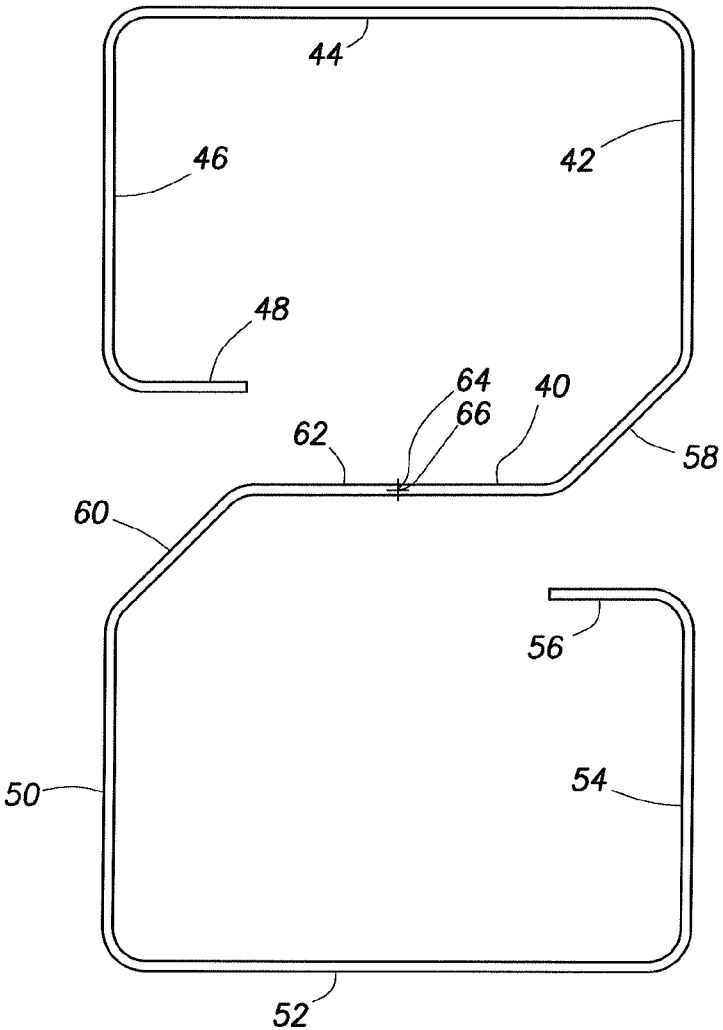
FIG. 4 is a cross-sectional view of a preferred embodiment of a web member.
Figure 5:
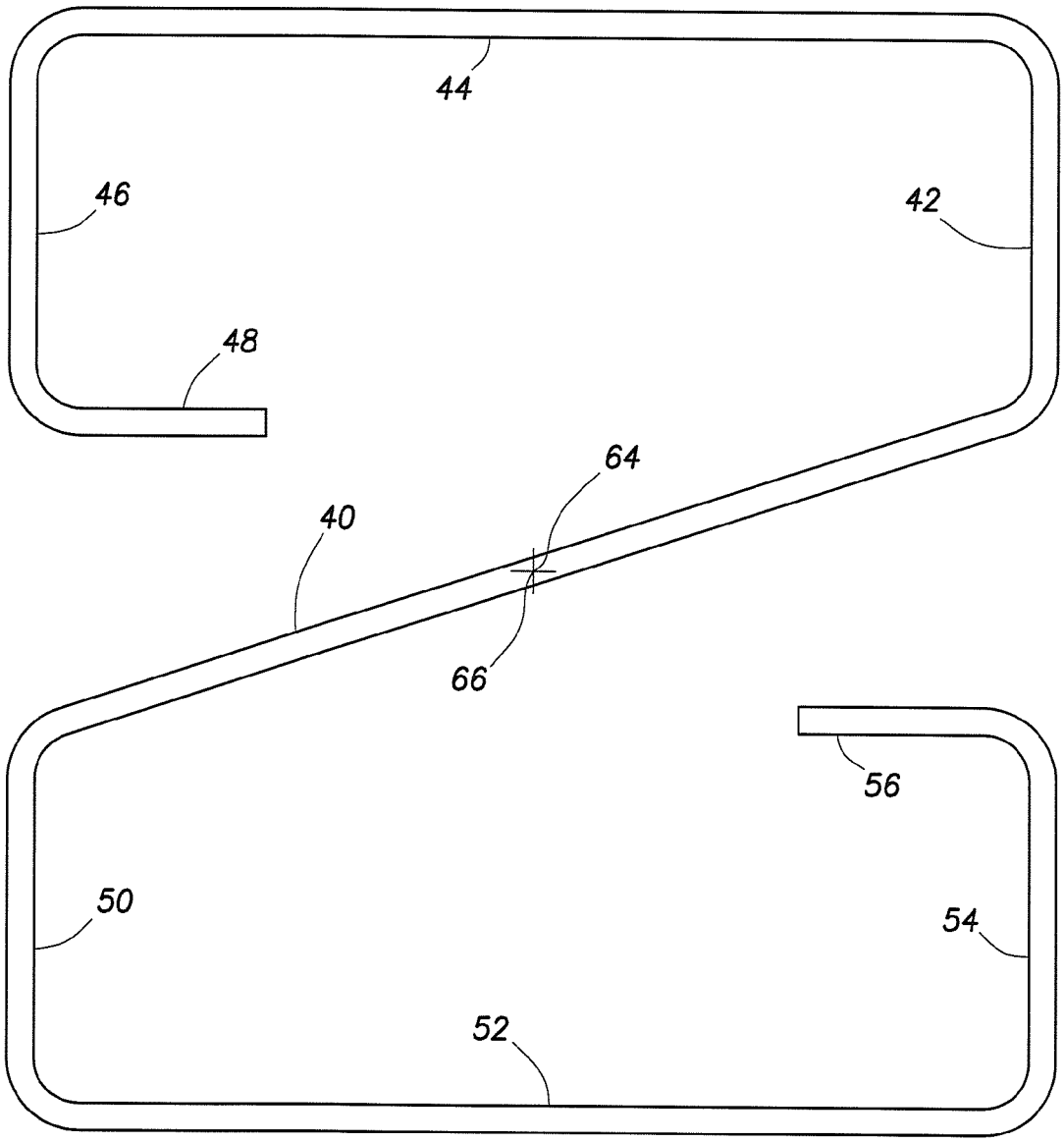
FIG. 5 is a cross-sectional view of a second embodiment of a web member.

Turning to a description of a preferred web member 18, web members 18 can be seen in FIG. 3 fitted into lower chord 12, and cross-sectional views of two preferred embodiments of web members 18 can be seen in FIGS. 4-5. The generally S-shaped web member 18 is made up of a central web 40, an upper flange 42, upper leg 44, upper return 46, lower flange 50, lower leg 52 and lower return 54. The web member 18 can also include an upper lip 48 and lower lip 56 extending from, respectively, the upper return 46 and lower return 54.

The upper flange 42 extends from the central web 40 and is preferably approximately perpendicular to the central web. The upper leg 44 extends from the upper flange 42, again preferably perpendicularly. The upper return 46 extends from the upper leg 44, preferably perpendicularly. The upper return 46 extends from the upper leg 44 towards the central web 40 and is preferably perpendicular to the upper leg. The lower portion of the web member has similar relationships between the lower flange 50, lower leg 52 and lower return 54. An upper lip 48 and lower lip 56 can also be included and extend generally perpendicularly from the upper return 16 and lower return 54, respectively. Stiffening ribs can be added to the web member.

As seen in FIGS. 2-4, the upper return 46 and lower flange 50 are generally co-planar, as are the upper flange 42 and lower return 54. This arrangement reduces problems attaching the web member 18 to a chord.

The bends in the web member, for example, where the upper flange and upper leg meet, may be curved as shown, with shorter or longer radius of curvature, for ease of construction.

In a preferred embodiment, the upper and lower portions of the web member have similar dimensions. That is, the upper and lower flanges each extend the same distance D from the central web 40, and the width W of the web member is the same across the entire height H of the web member. Further, in a preferred embodiment, the upper and lower portions of the web member are point or rotationally symmetric as shown. Preferably the material of the web member is of uniform thickness throughout. The overall width W and height H of the web member can vary depending on the application, size of chord to be used, required characteristics of the web member and other design considerations.

The central web 40 of the web member 18 can extend generally perpendicularly to the upper and lower flanges 42 and 50, as seen in FIG. 4. In this case, the central web 40 is also generally parallel to the upper and lower legs 44 and 52. The central web 40 can also have first and second end portions 58 and 60 at either end of a center portion 62, as seen in FIG. 4. These end portions 58 and 60 are shown at a 45 degree angle to the center portion 62. Other angles may be used. Preferably these end portions 58 and 60 of the central web 40 are positioned such that the flanges and returns are aligned with one another. That is, as shown, the upper flange 42 and upper return 46 are of the same length and positioned opposite one another. Since the flange and return are used to attach the web member 18 to a chord, the alignment of the flange and return help insure that a user does not insert a fastener through only one of the flange or return. The end portions 58 and 60 of the central web 40 provide the user with a visual guide as to where to insert a fastener 20. That is, the user should not insert the fastener 20 through the angled end portions 58 or 60, but rather through the flange and/or return portions of the web member 18.

Alternately, as seen in FIG. 5, the central web 40 can be arranged at a diagonal to the upper and lower flanges 42 and 50. The embodiment with a diagonally disposed central web 40 uses less material than a perpendicularly disposed central web, for similarly dimensioned web members. It also may be preferred where the dimensions of the web member make multiple bends in the web member difficult to fabricate. Preferably, the central web 40, if angled with respect to the flanges 42 and 50, is of a length and angle such that the flanges are aligned with the returns. As explained above with respect to the angled end portions of the central web, this will provide a guide to the user as to where to insert fasteners through the web member.

If the cross-section of the web member 18 is point symmetric, as shown in FIGS. 4 and 5, then the center of gravity 64 and center of shear 66 of the cross-section of the web member 18 coincide. Also, the center of gravity 64 and center of shear 66 fall within the cross-sectional area of the web member 18, as shown. That is, the centers of shear and gravity fall on, or in, the central web 40. Shapes that minimize the distance between the center of gravity and center of shear have better performance characteristics than those where the centers of gravity and shear are separated. C-shaped channels, for example, are prone to flexural torsional buckling since their centers of gravity and shear do not coincide. For example, a web member with coinciding centers of shear and gravity are less likely to fail in flexural torsional buckling mode.

Figure 6:
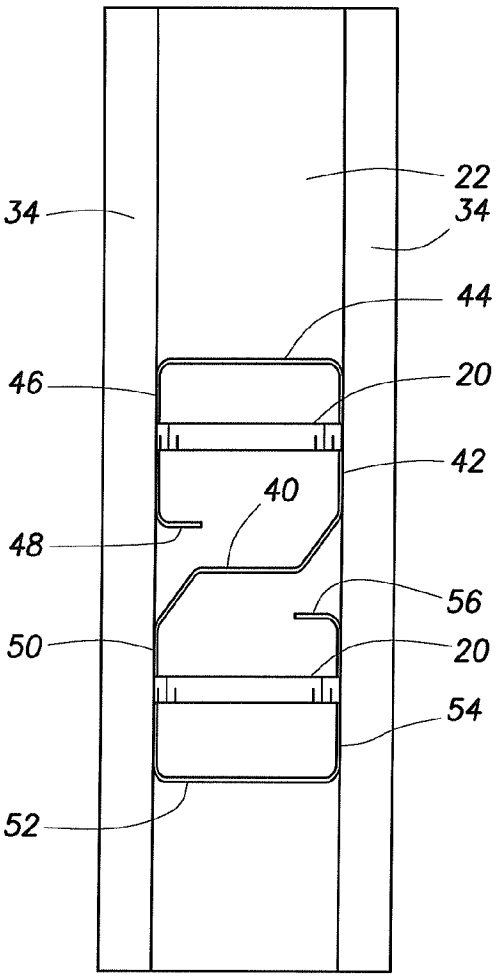
FIG. 6 is a top view of a lower chord 18, with a web member 18 shown in cross-section.

FIG. 6 is a top view of a lower chord 18, with a web member 18 shown in cross-section with fasteners 20 extending through the web member and chord. As seen in FIGS. 1-3 and 6, each web member 18 extends into the interior space 36 of the upper and lower chords 12 and 14. Shown in FIG. 6 is a web member 18 extending into a lower chord 12 with the web member and chord perpendicular to one another. It is understood that each web member can extend into the interior space of the upper chord, lower chord, or preferably both. It is also understood that the web members may intersect the chords at angles other than the perpendicular, as seen in FIG. 3 for example.

One end of the web member 18 extends into the open interior space defined by the channel-shaped lower chord 12. Central web 40 of web member 18 is preferably oriented at a generally perpendicular angle with respect to the longitudinal extent of chord 12, that is, generally parallel with the legs 24 of the chord. Upper and lower flanges 42 and 50 and upper and lower returns 46 and 54 may serve as attachment faces for attaching the web member to the chord. Preferably, the upper flange 42 and lower return 54 contact one leg 24 of the chord while lower flange 50 and upper return 46 contact the opposite leg 24 of the chord.

Figure 7:
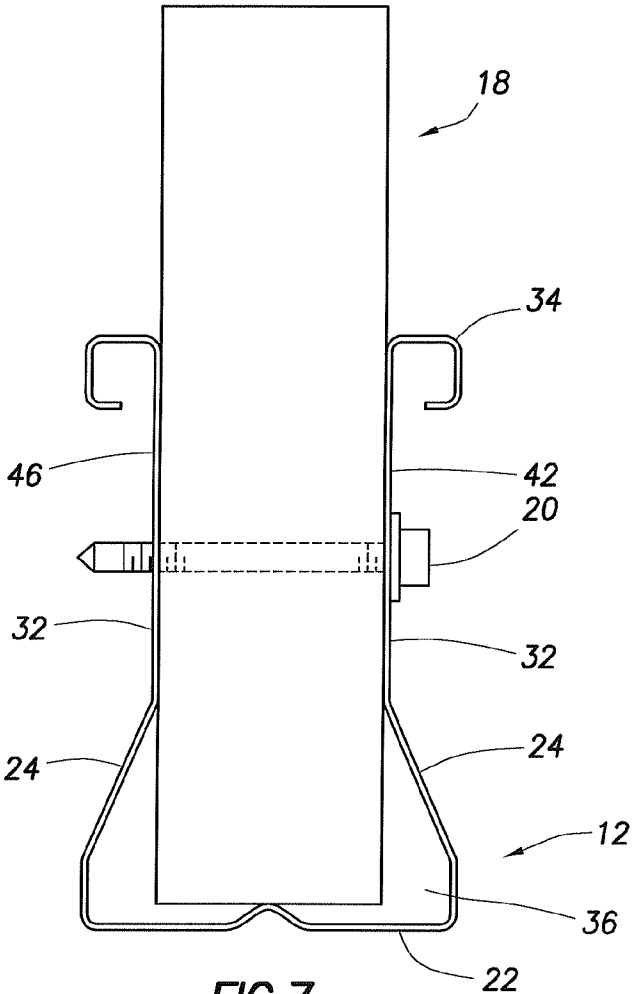
FIG. 7 is a cross-sectional front view of a web member extending into a chord.

As can be seen in FIG. 7, which presents a cross-sectional front view of a web member attached to a chord, one end of the web member 18 preferably contacts the base 22 of the chord 12.

One or more fasteners 20 are employed to attach the web member to the chord. In a preferred embodiment, as seen in FIGS. 6-7, each fastener extends through both legs 24 of the chord 12 and through a flange and return of the web member 18. Self-tapping screws are shown, although other attachment mechanisms may be used. One such fastener 20 extends through the leg 24 of the chord 12 at attachment planar portion 32, through adjacent upper flange 42, through the upper return 46, and then through the opposite leg 24 of the chord 12, again at attachment portion 32. Multiple fasteners can be employed to connect a web member to a chord. Preferably at least one fastener extends through the upper flange and return while at least one other fastener extends through the lower flange and return of the web member. Alternately, a fastener can extend only through one leg of the chord and through one of either a flange or return of the web member. As can be seen, co-planar flanges and returns of the web member provide attachment faces for the legs of the chord. Upper flange 42 and lower return 54, which are preferably co-planar, align with one leg 24 of the chord, while lower flange 50 and upper return 46 align to provide attachment faces to the other chord leg.

Details are shown only for one end of the web member extending into and being attached to the lower chord. A similar arrangement is used to attach the opposite end of the web member to the upper chord.

Figure 8:
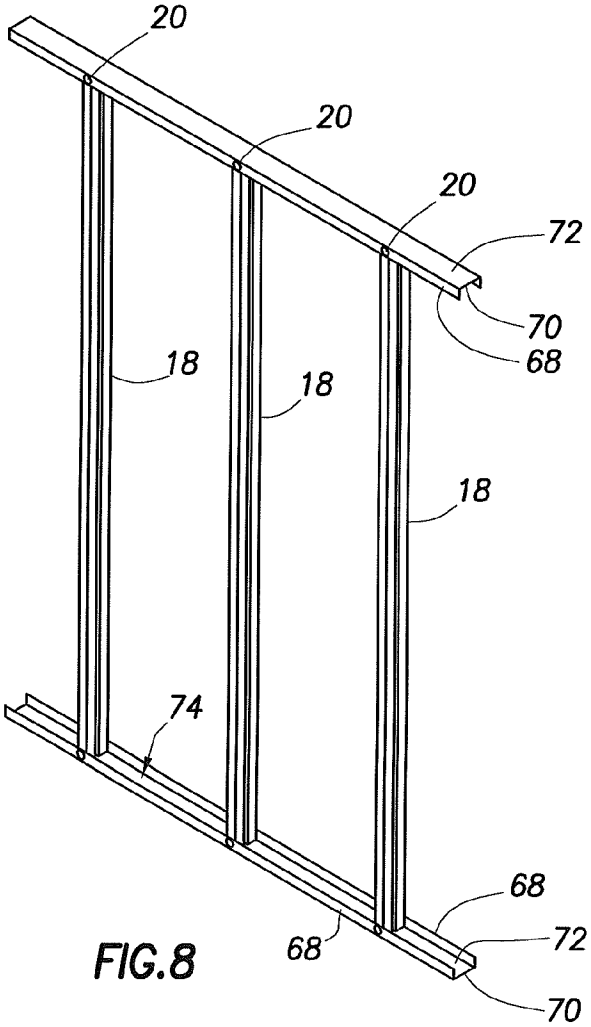
FIG. 8 is an orthogonal view of a metal wall truss having two generally parallel chords with web members extending between the chords, the web members acting as wall studs.

FIG. 8 presents another embodiment of the invention. Here, the generally S-shaped web members 18 are employed as wall studs between two generally parallel chords 72 to create a wall truss assembly. Each end of the web member 18 extends into an open space 74 defined by the legs 68 and base 70 of the chord 72. The chords 72 are preferably generally U-shaped, as shown. Here the chord legs 68 are simple planar portions with inwardly sloping portions or flanges. Similar simple chords may be used for construction of the roof truss assembly described above.

Although preferred embodiments of the invention have been described in the foregoing detailed description and illustrated in the accompanied drawings, it is understood that the invention is not limited to the embodiments disclosed, but is capable of numerous arrangements, modifications and substitutions of parts and elements without departing from the spirit of the invention. Accordingly, the present invention is intended to encompass such arrangements, modifications and substitutions of parts and elements as fall within the scope of the invention. The invention is limited only by the appended claims.

What is claimed is:

1. A truss assembly apparatus comprising:

a roof truss assembly having a plurality of chord and web members connected together;

a pair of elongated, opposed diverging metal upper chords;

at least one metal lower chord;

the upper and lower chords each forming generally U-shaped channels, each U-shaped channel defining an interior chord space;

a plurality of elongated metal web members extending between the upper and lower chords, the web members extending into the interior space of an upper chord, the web members extending into the interior space of at least one lower chord, each of the web members attached to an upper chord and to at least one lower chord; and wherein the web members have a generally S-shaped cross-section;

wherein the web members each have a central web, an upper flange extending from the central web, an upper leg extending from the upper flange, an upper return extending from the upper flange, an upper lip extending from the upper return, a lower flange extending from the central web, a lower leg extending from the lower flange, a lower return extending from the lower leg, and a lower lip extending from the lower return; and wherein the upper and lower flanges are generally parallel to one another, wherein the upper and lower legs are generally parallel to one another, wherein the upper and lower returns are generally parallel to one another, and wherein the upper flange and lower return are generally coplanar, wherein the lower flange and upper return are generally coplanar, and wherein the upper and lower lips are generally perpendicular to the upper and lower returns.

2. The apparatus as in claim 1 wherein the central web is generally perpendicular to the upper and lower flanges.

3. The apparatus as in claim 1 wherein the central web lies at a diagonal in relation to the upper and lower flanges.

4. The apparatus as in claim 1, wherein each web member has a cross-section, and wherein the cross-section of the web member has a center of gravity and a center of shear, and wherein the center of gravity and center of shear coincide.

5. The apparatus as in claim 4, wherein each of the web members has a cross-sectional area, and wherein the center of gravity and center of shear fall within the cross-sectional area of the web member.

6. The apparatus as in claim 1, wherein each of the upper and lower chords are formed of a chord base extending between two opposed chord legs, and wherein the two opposed legs are of generally the same length.

7. The apparatus as in claim 6, wherein the two chord legs each include planar portions generally perpendicular to the chord base, and wherein each of the two chord legs includes a sloped portion, and wherein the sloped portions are at diagonal angles to the chord planar portions.

8. The apparatus as in claim 6, wherein the web members contact at least one of the chord bases.

9. The apparatus as in claim 1, wherein a portion of the upper flange of the web member contacts one of the legs of the upper chord, and wherein the portion of the upper flange of the web member is attached to the leg of the upper chord.

10. The apparatus as in claim 9, wherein a portion of the lower flange of the web member contacts the other leg of the upper chord, and wherein the portion of the lower flange of the web member is attached to the other leg of the upper chord.

11. The apparatus as in claim 1, wherein each web member is attached to a chord by a plurality of fasteners, and wherein at least one fastener extends through the chord and through the upper flange and upper return of a web member.

12. The apparatus as in claim 11, wherein at least one fastener extends through the chord and through the lower flange and lower return of a web member.

13. The apparatus as in claim 11, wherein the chord has two opposed, generally parallel chord legs extending from a chord base, and wherein at least one fastener extends through each of the chord legs and through the upper flange and upper return of the web member.

14. The apparatus as in claim 1, wherein at least one of the chords has a chord base with two opposed chord legs extending from the chord base, and wherein the chord legs each have a longitudinal extent, and wherein the central web of at least one of the web members is oriented at approximately a ninety degree angle to the longitudinal extent of the chord legs.

15. The apparatus as in claim 1, wherein the upper and lower legs are generally perpendicular to the upper and lower flanges, and wherein the upper and lower returns are generally perpendicular to the upper and lower legs.

16. The apparatus as in claim 1, wherein the central web has a middle portion and two end portions, and wherein the end portions are positioned at diagonals with respect to the middle portion of the central web.

17. The apparatus as in claim 16, wherein the end portions of the central web guide the user in inserting fasteners through the web member.

18. A truss assembly apparatus comprising:

a roof truss assembly having a plurality of chord and web members connected together;

a pair of elongated, opposed diverging metal upper chords;

at least one metal lower chord;

the upper and lower chords each forming generally U-shaped channels, each U-shaped channel defining an interior chord space;

a plurality of elongated metal web members extending between the upper and lower chords, the web members extending into the interior space of an upper chord, the web members extending into the interior space of at least one lower chord, each of the web members attached to an upper chord and to at least one lower chord;

wherein the web members have a generally S-shaped cross-section;

wherein the web members each have a central web, an upper flange extending from the central web, an upper leg extending from the upper flange, an upper return extending from the upper flange, an upper lip extending from the upper return, a lower flange extending from the central web, a lower leg extending from the lower flange, a lower return extending from the lower leg, and a lower lip extending from the lower return;

wherein the chords have two opposed, generally parallel chord legs extending from a chord base;

wherein each web member is attached to a chord by a plurality of fasteners, and wherein at least one fastener extends through each of the chord legs of the chord and through the upper flange and upper return of a web member, and wherein at least one fastener extends through each of the chord legs of the chord and through the lower flange and lower return of the web member.

19. A truss assembly apparatus comprising:

a roof truss assembly having a plurality of chord and web members connected together;

a pair of elongated, opposed diverging metal upper chords;

at least one metal lower chord;

the upper and lower chords each forming generally U-shaped channels, each U-shaped channel defining an interior chord space;

a plurality of elongated metal web members extending between the upper and lower chords, the web members extending into the interior space of an upper chord, the web members extending into the interior space of at least one lower chord, each of the web members attached to an upper chord and to at least one lower chord; and wherein the web members have a generally S-shaped cross-section;

wherein the web members each have a central web, an upper flange extending from the central web, an upper leg extending from the upper flange, an upper return extending from the upper flange, an upper lip extending from the upper return, a lower flange extending from the central web, a lower leg extending from the lower flange, a lower return extending from the lower leg, and a lower lip extending from the lower return; and wherein the upper and lower flanges are generally parallel to one another, wherein the upper and lower legs are generally parallel to one another, wherein the upper and lower returns are generally parallel to one another, and wherein the upper flange and lower return are generally coplanar, wherein the lower flange and upper return are generally coplanar, and wherein the upper and lower lips are generally perpendicular to the upper and lower returns;

wherein the central web has a middle portion and two end portions, and wherein the end portions are positioned at diagonals with respect to the middle portion of the central web.

20. The apparatus as in claim 19, wherein the end portions of the central web guide the user in inserting fasteners through the web member.

* * * * *